US008813949B2

(12) United States Patent
Berni

(10) Patent No.: US 8,813,949 B2
(45) Date of Patent: Aug. 26, 2014

(54) APPARATUSES AND METHOD FOR TRANSFERRING FLEXIBLE FLAT OBJECTS

(75) Inventor: Claudio Berni, Hombrechtikon (CH)

(73) Assignee: Ferag AG, Hinwil (CH)

( * ) Notice: Subject to any disclaimer, the term of this patent is extended or adjusted under 35 U.S.C. 154(b) by 504 days.

(21) Appl. No.: 13/140,569

(22) PCT Filed: Dec. 16, 2009

(86) PCT No.: PCT/CH2009/000398

§ 371 (c)(1),
(2), (4) Date: Jul. 22, 2011

(87) PCT Pub. No.: WO2010/072006

PCT Pub. Date: Jul. 1, 2010

(65) Prior Publication Data

US 2011/0284342 A1 Nov. 24, 2011

(30) Foreign Application Priority Data

Dec. 24, 2008 (CH) ..... 2017/08

(51) Int. Cl.

| | |
|---|---|
| ***B65G 17/16*** | (2006.01) |
| ***B65H 5/08*** | (2006.01) |
| ***B65H 29/66*** | (2006.01) |
| ***B65H 29/00*** | (2006.01) |

(52) U.S. Cl.

CPC ..... *B65H 5/085* (2013.01); *B65H 2301/44712* (2013.01); *B65H 2301/42244* (2013.01); *B65H 29/6672* (2013.01); *B65H 2301/323* (2013.01); *B65H 29/003* (2013.01); *B65H 2301/42242* (2013.01)

USPC ..... 198/470.1; 270/52.16; 270/58.29; 198/464.2

(58) Field of Classification Search

None

See application file for complete search history.

(56) References Cited

U.S. PATENT DOCUMENTS

| | | | | |
|---|---|---|---|---|
| 4,201,286 | A * | 5/1980 | Meier | 198/461.3 |
| 5,188,349 | A | 2/1993 | Honegger | |
| 5,660,382 | A * | 8/1997 | Meier | 270/52.16 |

FOREIGN PATENT DOCUMENTS

| | | |
|---|---|---|
| EP | 1281650 | 2/2003 |
| EP | 1321410 | 6/2003 |
| EP | 1547950 | 6/2005 |
| EP | 1834911 | 9/2007 |

* cited by examiner

*Primary Examiner* — Kavel Singh

(74) *Attorney, Agent, or Firm* — Rankin, Hill & Clark LLP

(57) ABSTRACT

An apparatus and a method for transferring flexible flat objects, in particular printed products, between two conveyers wherein the apparatus includes a first gripper conveyor having first grippers moved along a first gripper conveying path for the substantially suspended transport of the objects in a conveyor device by seizing a first object edge, a second gripper conveyor having second grippers moved along a second gripper conveying path for receiving the objects by seizing a second object edge located opposite of the first object edge, at least one actuating apparatus for opening and closing the first and second grippers such that a transfer of the objects from the first grippers to the second grippers can take place in a transfer region. At least one auxiliary conveyor including auxiliary grippers carried along an auxiliary conveyor conveying path together with the first grippers is provided.

14 Claims, 6 Drawing Sheets

APPARATUSES AND METHOD FOR TRANSFERRING FLEXIBLE FLAT OBJECTS

BACKGROUND OF THE INVENTION

1. Field of the Invention

The invention lies in the field of conveying technology and relates to devices and to methods for the transfer of flexible, two-dimensional objects, in particular printed products, between two conveyors.

2. Description of Related Art

In conveyor technology, and in particular in the field of printing technology, it is often necessary to transfer objects from grippers of a first gripper conveyor into grippers of a second gripper conveyor. For example, printed products coming from a printing machine are often held and conveyed in groups, e.g. as a pair of two products, by way of a common gripper, for increasing the conveying rate. For the further processing, they must be singularised. At least individual ones of the products are therefore preferably transferred to grippers of the second gripper conveyor in such a way, that each product is finally held individually.

The objects are often held by a common gripper in a congruent manner (with edges which are aligned onto one another). It may however be advantageous for singularising the commonly held objects, to clamp the objects in the gripper such that their held edges are offset to one another (differentiated conveying).

Different cases of how a gripper-gripper transfer may take place, with regard to the method, are outlined in EP-B 1321410, for example: 1. transfer of two products held by a common first gripper to two consecutive second grippers; 2. transfer of each second product pair to two consecutive second grippers and subsequent division also of the product pairs remaining in the first gripper; 3. transfer of only one of the products of the product pair in each case to a second gripper and further conveying the non-transferred product by the first gripper.

Separating objects which are conveyed in pairs, but also the transfer of individual objects from one first gripper to a second one, requires particular demands to the extent that the object edge which is not gripped, is positioned in a reliable manner such that it is led in an as accurate as possible manner into the open gripper jaw of the second gripper. This is important with flexible products such as e.g. printed products, since on conveying they are only held at one product edge and may change their position due to external influences such as e.g. drafts.

For stabilising the objects, the device according to EP-B 1321410 envisages a flat underlay which is not described in more detail and on which the free object edges drag, whilst the objects are conveyed by the first grippers, and which ends in the region, in which the second grippers approach the free object edges from below.

EP-A 1834911 describes a further transfer device, with which individual objects are transferred by first grippers to synchronously moved second grippers. The second grippers are arranged below the first grippers. The first grippers are opened in a transfer region, so that the objects slide into the co-moved, open second grippers on account of gravity, said second grippers being closed upon this. A stabilisation device, which comprises two spiral or helical rotors orientated in opposite directions, is provided for stabilising the objects during the transfer or in the transfer region. These rotors in each case immerse laterally into the intermediate spaces between the objects held by the first grippers and thus form an essentially vertically orientated two-dimensional support which co-moves with the objects over the whole transfer region, holds these in a straight manner and only ends when the second gripper is closed. The disadvantage of this arrangement is the relatively large volume which is taken up by the lateral rotors, as well as the complexity of the complete stabilisation device. This is because the rotors have a certain extension in the conveying direction as well as transversely to the conveying direction and this extension corresponds roughly to the length of the transfer region or to the rotor diameter. The rotor diameter may not be made infinitely small, since a reliable surfaced guidance of the objects would otherwise not be possible. Finally, also it is only the position of the objects in the conveyor direction which is set by the stabilisation device, whilst the position of the free edge in the vertical direction remains undefined.

If the first gripper conveys more than one object, but not all are however to be released, the objects which remain in the first gripper have to be held in a temporary manner when the gripper opens. For this, EP-B 1321410 suggests two alternative solutions. On the one hand the use of a special gripper is suggested, which comprises two clamping regions which are independent of one another and thus may selectively release an object, whilst the other continues to be held. On the other hand, an additional auxiliary gripper conveyor is suggested, whose auxiliary grippers in the transfer region are moved synchronously with the first grippers and the objects which are not to be released are firmly held during the opening of the first gripper and by way of this are held back in the opened first gripper.

A problem with the differentiated conveying of several objects in a common gripper may be that the object remaining in the gripper does not have the optimal position relative to the gripper jaws or to the pivot axis on account of the initial offset.

BRIEF SUMMARY OF THE INVENTION

It is therefore an object of the invention to specify a device and a method for the transfer of flexible, two-dimensional objects from a first gripper conveyor to a second gripper conveyor, with which device or method the outlined disadvantages are avoided. In particular, according to a first aspect of the invention, in particular with a differentiated conveying, a positional correction of the objects remaining in the gripper may be achieved with simple means. According to a second aspect of the invention, a reliable positioning of the free object edge is to be achieved with simple means.

The device according to the invention comprises a first gripper conveyor with first grippers which are moved along a first gripper conveying path, for the essentially hanging transport of the objects in a conveying direction. Hereby, first object edges are gripped by the first grippers. The objects are conveyed individually or in groups. With a grouped conveying, the first object edges may lie on one another or be offset to one another within the gripper. A second gripper conveyor with second grippers moved along a second gripper conveying path is also present. These second grippers receive the objects by way of them gripping a second object edge which lies opposite the first object edge. Moreover, at least one actuation device for opening and closing the grippers is present, e.g. in the form of control cams or other elements which activate the opening or closing procedure. Each conveyor preferably has its own actuation device. The conveying paths and the actuation device are designed and set up such that a transfer of the objects from the first grippers to the second grippers may take place in a transfer region.

According to the first aspect of the invention, at least one auxiliary conveyor with auxiliary grippers which are co-moved with the first grippers along an auxiliary conveyor conveying path is present. The auxiliary grippers are capable of gripping and fixing the first object edges of individual or all held objects in the transfer region, so that the objects which are held by the auxiliary gripper do not fall down on opening the first gripper and may again be conveyed further by this first gripper after the closure of this. According to the invention, the gripper conveying path and the auxiliary conveying path run and the movements of the first gripper and of the auxiliary grippers are controlled in such a manner, that an object which in the meanwhile is held by the auxiliary gripper and which is then again released to the first gripper, at the end of the transfer region is held at a changed distance to its first object edge compared to the entry into the transfer region. A positional correction of the objects within the first gripper may be achieved in this manner. This is particularly advantageous with a differentiated conveying, with which at least one product does not necessarily have the optimal position relative to the first gripper, e.g. is introduced too deeply into the gripper, due to the offset of the held edges.

According to the second aspect of the invention, a stabilisation device for stabilising the objects held by the first grippers is present. According to the invention, this is arranged in front of the transfer region in the conveying direction, wherein the objects in the actual transfer region, thus during the transfer process, are already no longer influenced by it. The stabilisation device comprises abutment elements which are co-moved with the first grippers and by way of which the second object edges, up to the entry of the transfer region, are brought into a position which is defined in the conveying direction as well as in the vertical direction. The abutment elements stabilise the free edges in two dimensions and therefore reliably fix their position in space.

With regard to the method, the following steps are carried out: conveying the objects with the first gripper conveyor in an essential hanging manner in the conveying direction, wherein the first grippers hold the objects at a first object edge: further conveying the objects by the second gripper conveyor, wherein the second grippers hold a second object edge which lies opposite the first object edge; transferring the objects from the first grippers to the second grippers in the transfer region by way of opening the first grippers and closing the second grippers.

According to the first aspect, additionally: interim fixation of the objects which are not to be released, by way of auxiliary grippers for as long as the first grippers are opened for the object release, and re-transfer to the first grippers with an offset relative to the initial position in the first gripper. In particular, an object which is held by the auxiliary gripper and which is released again to the first gripper, at the end of the transfer region, is held at a changed distance from its first object edge compared to the entry into the transfer region.

According to the second aspect, additionally: stabilising the objects held by the first grippers, by way of a stabilisation device. According to the invention, the objects are stabilised in front of the transfer region by way of abutment elements of the stabilisation device being co-moved with the first grippers in a manner such that the second object edges at the entry of the transfer region are brought into a position which is defined in the conveying direction and in the vertical direction, wherein the second object edges are released again directly in front of the transfer region or at the entry of the transfer region.

The two variants of the invention may also be combined amongst one another.

A transfer region is to be understood as that region, in which the transfer process of the objects form the first grippers to the second grippers may take place, in particular since the grippers have approached one another to such an extent, that a controlled transfer is possible. In the transfer region, the object may preferably be influenced by the first grippers as well as by the second grippers. A controlled transfer, with which the objects are gripped at every point in time, takes place, for example, by way of the second grippers or auxiliary grippers co-moved with these being closed and the first grippers subsequently being opened.

The invention has the following advantages:

First aspect: an interim fixation of the objects which are not to be released and simultaneously a positional correction with the return to the first gripper is possible with simple means. This simplifies the subsequent processes which are reliant upon a defined position of the object within the gripper, in particular with a differentiated conveying in the incoming product stream. The auxiliary gripper conveyor may be realised in a mechanically very simple manner. For example, the auxiliary grippers may be moved along a circular conveying path, e.g. by way of them being attached on a rotation body. A path which is exactly parallel to the main gripper and thus a more complex guidance structure, e.g. a chain-channel system, is not necessary.

Second aspect: contrary to the state of the art according to EP-A 1834911, the objects are not guided during the complete transfer process, but only directly before the transfer. The support device used for this may be designed in a mechanically simple and space-saving manner. In the simplest case it is merely the case of co-moved abutment or support elements which support and position the second object edges. They may be arranged below the first gripper in front of the transfer region. Laterally projecting support designs or guide designs are avoided. In a preferred further formation of the invention, the support device has an essentially horizontally running rest surface, e.g. formed by one or more conveying belts, from which the abutment elements which are co-moved with the first grippers project, e.g. in the form of cams or projections.

The abutment elements are moved, for example, along an abutment element conveying path which in front of the transfer region comprises a section running parallel to the first conveying path.

By way of the second edges being released again by the abutment elements at the entry of the transfer region, they may be positioned very rapidly in the open second grippers. This process is preferably supported by bending the flexible objects by means of the stabilisation device. Preferably thereby, the second object edge trails the first object's edge in the conveying direction. The objects hang down freely again from the first gripper outside the region of influence of the stabilisation device, so that the second object edge, on release, executes a rapid movement and by way of this is positioned in a defined manner relative to the second gripper. Preferably, by way of the bending-relaxing, it overcomes a certain height difference and by way of this is already positioned deeply within the open second gripper jaw. The movement paths of the first and the second grippers and the respective drives are preferably set up such that the grippers in the transfer region are moved in a manner which is matched to one another, in particular in a synchronous manner.

The distance of the stabilisation device to the first gripper conveying path is preferably variable, for adaptation to the object length. Likewise, also the distance of the two gripper conveying paths from one another may preferably be varied.

The transfer device according to the invention may be applied in a flexible manner. In one operating variant, the objects may be conveyed individually by the first grippers and transferred individually to the second grippers. In this case, the complete product flow is transferred from the first conveyor to the second conveyors, or split upon transfer. In a further operating variant, in each case two or more objects are conveyed as a group by the first grippers. The transfer to the second grippers takes place in a controlled manner, so that all products of the group are transferred individually to consecutive second grippers and are conveyed further by these in an individual manner. Alternatively, only selected products of a group are transferred to the second grippers. It is also possible for only every second (or nth) first gripper to be opened and to release its products, whilst the remaining products are conveyed further by the first conveyor. In this case, a dividing of the product streams takes place.

The invention may be applied, in particular, for the transfer of groups of objects which are held in a common first gripper and whose first edges are offset to one another (differentiated conveying). This is because it is particularly the case with objects of the same format, that the second object edges hereby may be separated from one another in a simple manner by way of sliding on a plane rest surface of the stabilisation device. The abutment elements thereby position at least one of the second edges of the objects of a group. It has been found that it is not necessary to exactly position each of the second edges. In this case for example, one may introduce a separating element at the entry of the transfer region between second object edges which are distanced to one another, said objects being held by a common first gripper, by which means the transfer to different grippers is simplified.

One or more auxiliary conveyors may be present, whose movement path in the transfer region runs parallel to the path of the first or the second grippers, for supporting the product transfer, in particular with several products per gripper. The auxiliary conveyors, for example, serve for transferring the products commonly held in a first gripper into consecutive second grippers in a targeted manner or to hold one or more products in the first gripper despite the opening of the first gripper.

BRIEF DESCRIPTION OF THE DRAWINGS

Examples of the invention are represented and described hereinafter in the drawings. In a purely schematic manner are shown in.

DETAILED DESCRIPTION OF THE INVENTION

FIG. 1-5 shows a transfer device according to the invention in different operating variants.

Figure 3:
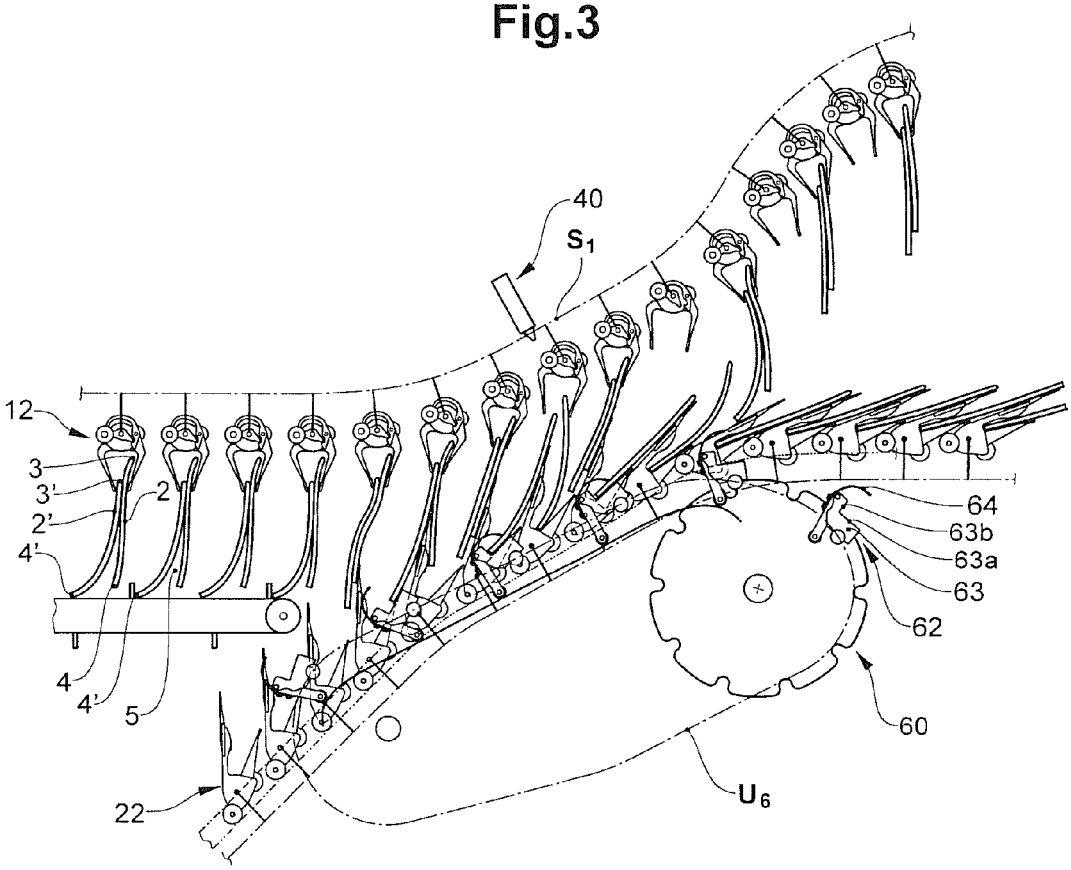
FIGS. 3 and 4 the transfer device according to FIG. 1, on transfer of objects with a first and a second larger format and conveyed in pairs, said transfer being supported by an auxiliary conveyor.
Figure 4:
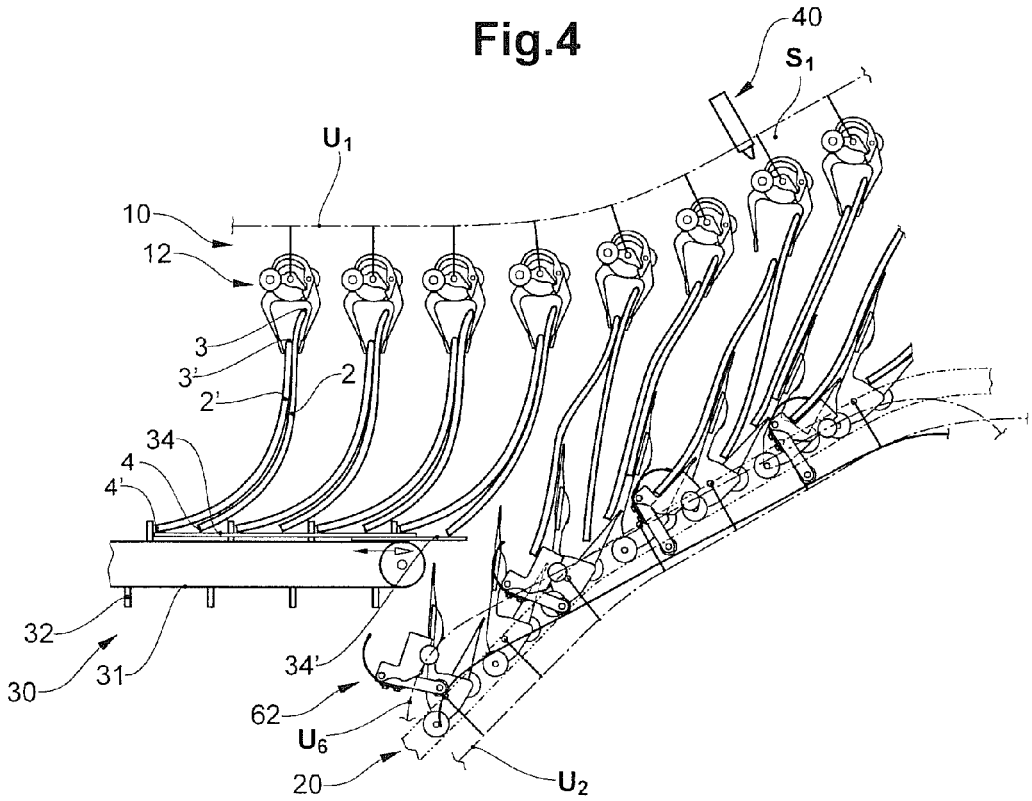
Figure 5:
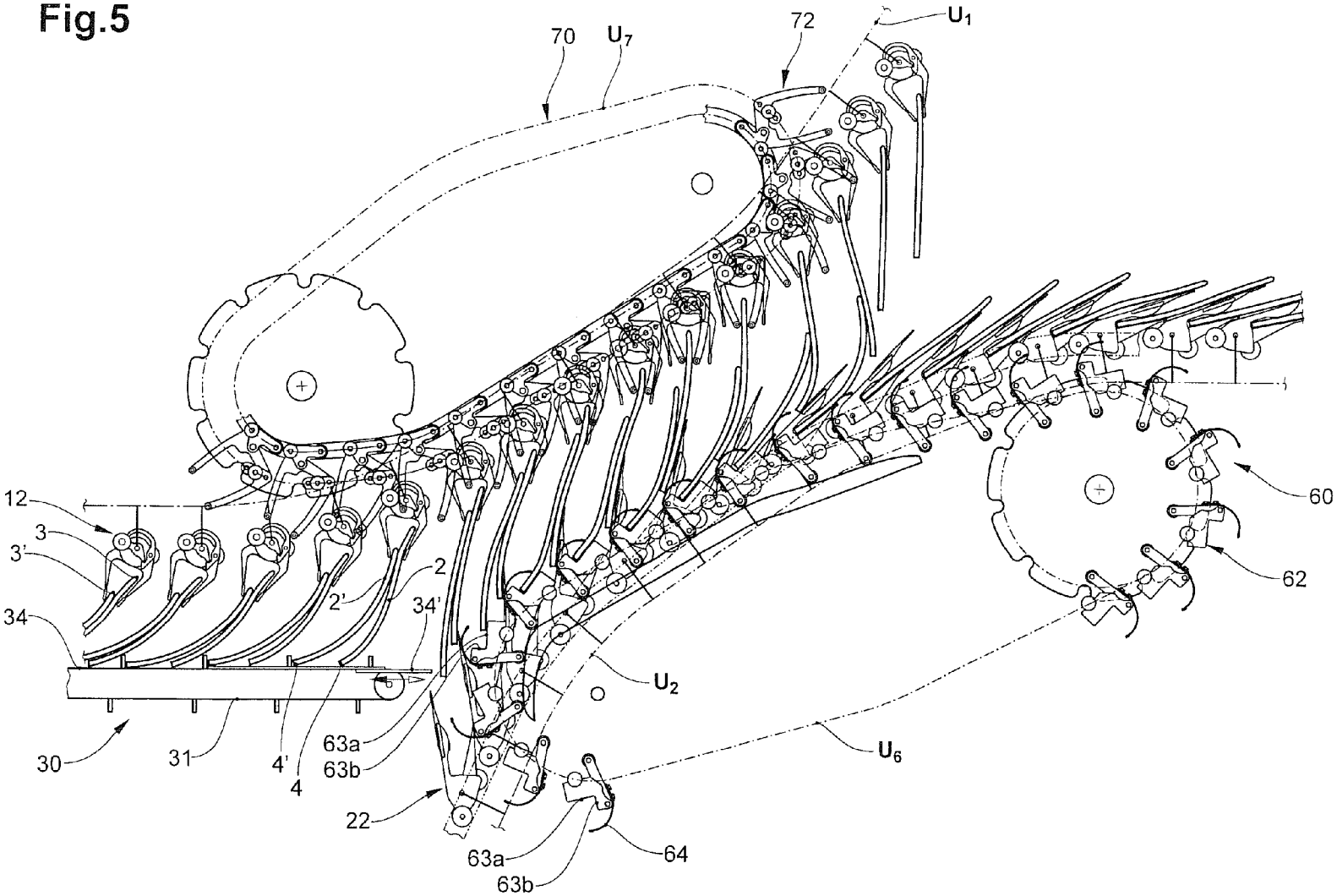
FIG. 5 the transfer device according to FIG. 1, on transfer of objects conveyed in pairs, said transfer being supported by a further auxiliary conveyor.

The transfer device 1 comprises a first gripper conveyor 10 with first grippers 12 which are moved in a conveying direction F along a first gripper conveying path U1 which is e.g. defined by a guide member which is not represented here. The first grippers 12 here are conventional grippers with two in each case roughly equally long gripper jaws 13, 14, which may assume an open position and a clamping position. The first grippers 12 are opened at an opening location S1 by way of a first actuation device 40 which here is only indicated in a schematic manner and may, for example, be designed as a control cam. For cooperating with the actuation device 40, the grippers 12 comprise control elements, e.g. cam rollers, in the known manner. The first gripper conveying path U1 here runs roughly horizontally in a first section U1' and then rises obliquely in a second section U1" The first grippers 12 convey objects 2 individually (FIGS. 1+2) or in pairs (FIG. 3-5), arriving from an upstream process. Thereby, the objects are held in each case at their first edge 3, and the oppositely lying second edges 4 point downwards in accordance with gravity. The first edges are offset to one another (differentiated conveying) with the paired conveying (FIG. 3-5).

The transfer device 1 moreover comprises a second gripper conveyor 20 with second grippers 22 which are moved along a second gripper conveying path U2. The second grippers likewise have two gripper jaws 23, 24 whose position relative to one another may be influenced by way of a second actuation device 50, e.g. a control cam. Here, the trailing gripper jaw 23 is extended compared to the leading gripper jaw 24. It permits the insertion between two objects 2 which are held by the first grippers 12 and hang freely down and the deflection of these into different (adjacent) second grippers 22. The trailing gripper jaw 23 thus also acts as a separating element. The second gripper conveying path U2 has a rising, first section U2' and an essentially horizontal section U2" which connects thereto. It is located directly below the first gripper conveying path U1.

The two gripper conveyors 10, 20 may be part of a primary conveying installation. Their conveying paths U1, U2 approach one another in a region which is hereinafter indicated as the transfer region T, to such an extent that an object 2 held by one of the grippers 12, 22 may be influenced by the other gripper. A controlled transfer of the objects 2 may take place in this manner. At the entry E of the transfer region T, the conveying paths U1, U2 run towards one another with a reducing distance and then preferably run essentially parallel to one another. The transfer region T corresponds roughly to the overlap of two parts U1", U2" of the first and second conveying path U1, U2 respectively, up to the closure location S2 of the second grippers 22. The entry E of the transfer region is for example that location, at which the second grippers 22 or their extended trailing limbs 23 pass through the plane, in which the product edges 4, 4' were held by the stabilisation device 30 (plane of the rest surface 34).

The transfer device 1 may further comprise first and second auxiliary conveyors 60, 70 which in each case comprise auxiliary grippers 62, 72 which are moved along respective conveying paths U6, U7. These at least in sections (in particular in the transfer region T) run parallel to the conveying paths U1, U2 of the first and second gripper conveyors 10, 20 respectively. The function of the auxiliary conveyors 60, 70 is explained further below with reference to FIGS. 3-5. For the transfer of individual objects (non-differentiated conveying), e.g. as in FIGS. 1 and 2, they are dispensable.

According to the invention, the stabilisation device 30 is located below the first section U1' of the first conveying path U1, i.e. in front of the entry E of the transfer region T. Here, it comprises a driven conveyor belt 31 whose upper section forms a plane rest surface 34. This is orientated parallel to the first section U1' of the first conveying path U1. Several abutment elements 32 project from the conveyor belt 31 and are likewise co-driven. They therefore run along an abutment element conveying path U3 which is defined essentially by the conveyor belt 31. The conveyor belt 31 is deflected at the entry E of the transfer region T, so that the stabilisation device 30 ends there. The distance d1 of the rest surface 34 to the first conveying path U1 is preferably variable and is set such that it is smaller than the length of the products in the vertical direction.

The distance d2 of the two gripper conveyors 10, 20 is preferably adjustable in the transfer region T. Particularly preferably, the stabilisation device 30 is coupled to the second gripper conveyor 20, so that their distance to one another remains constant. The distances d1, d2 are enlarged in FIG. 2 compared to FIG. 1, since longer products 2 are processed.

Figure 1:
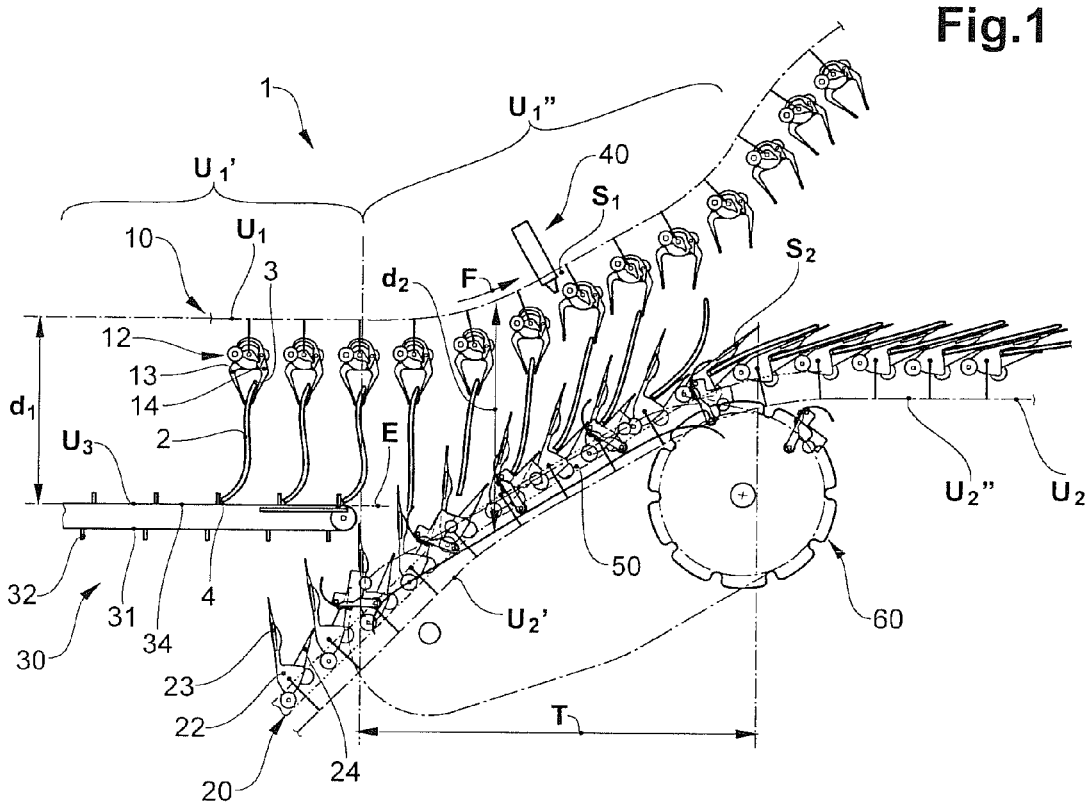
FIG. 1 a transfer device with a first gripper conveyor, with a second gripper conveyor and with a stabilisation device which is arranged in front of the transfer region, with the transfer of individual objects of a first format.

The function of the transfer device is described hereinafter:

In FIG. 1, the first grippers 12 convey the objects 2, by way of these being held at the first edge 3. The second edge 4 thereby lies on the rest surface 34 of the stabilisation device 30 and abuts on the abutment elements 32, so that the objects 2 are made to sag or are slightly squashed (tensioned) opposite to the conveying direction F. The exact position of the second edges 4 in the conveying direction is thereby determined by the position of the co-moved abutment elements 32. The position in the vertical direction is defined by the position of the rest surface 34 (height or distance to U1). The second grippers 22 approach one another from below the (imagined) plane which is defined by the rest surface 34, and pass through this at the entry E of the transfer region. The grippers 12, 22 and the abutment elements 32 are synchronised such that the second edge 4 bearing on the abutment element 32, on release by the stabilisation device 30, i.e. at the front end of the stabilisation device 30, due to the relaxation, springs into the intermediate space between two trailing gripper jaws 23 of adjacent grippers 22 or into an open second gripper 22. Preferably, the long gripper jaw 23 is flush with the front end of the stabilisation device 30 when the abutment element 32 runs through the front end and thus releases the second edge 4. The second edge 4 is therefore positioned relatively deeply within a second gripper 22 right at the beginning of the transfer region T. The second edge 4 comes to lie at the base of the gripper jaw by way of the two conveying paths U1, U2 further approaching one another in a first section of the transfer region. The second gripper 22 may now be closed by the actuation device 50 in a second section of the transfer region T. Shortly before this, the first gripper 12 is opened by the actuation device 40. The first gripper 12 may also be opened only when the second gripper 22 has been closed, in order to achieve a particularly controlled transfer. The extended, trailing gripper jaws 23 of the second grippers 22 after the transfer serve as a support surface for the objects which are then orientated in a leading manner. The auxiliary grippers 62 of the lower auxiliary conveyor 60 although being co-moved synchronously with the second grippers, however remain open and are therefore without any function.

Figure 2:
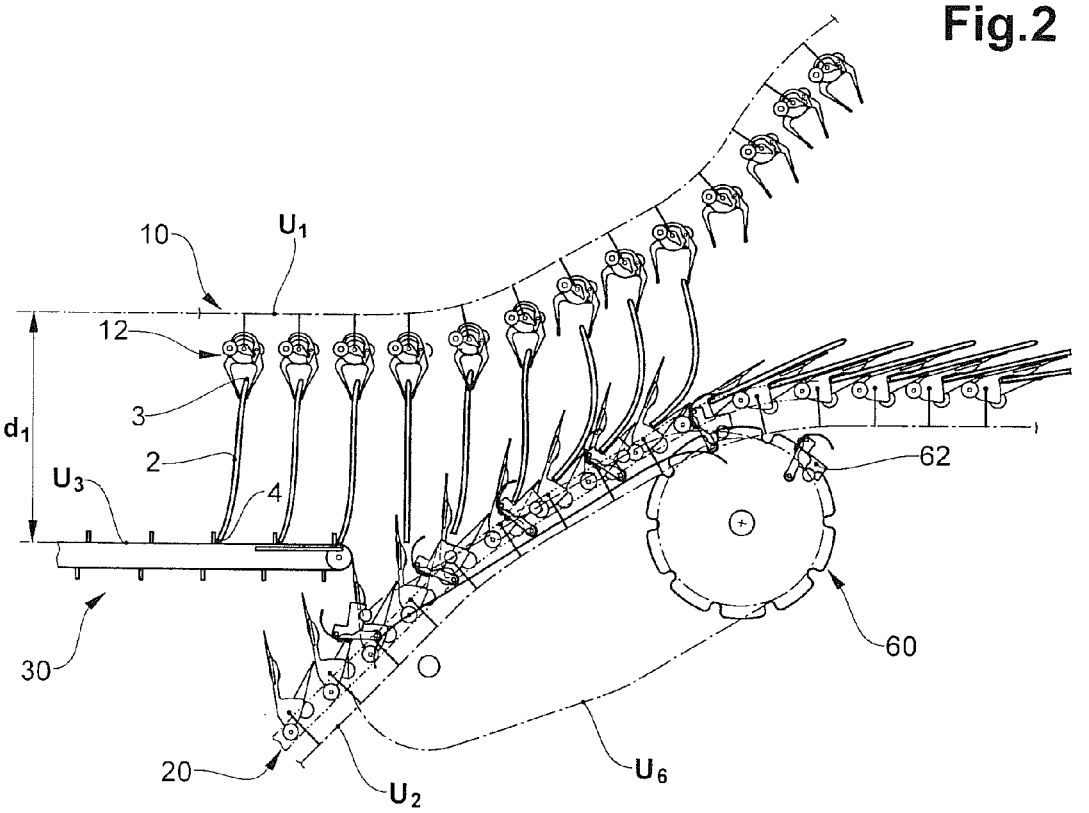
FIG. 2 the transfer device according to FIG. 1 on transfer of individual objects of a second, larger format.

FIG. 2 corresponds to FIG. 1 with the difference that the product length and the distance d1 are enlarged. The second edges 4, as with FIG. 1, bear on the abutment elements 32. The trailing extended gripper limbs 23 of the second grippers 22 are aligned with the rest surface 34 likewise at the point in time of the release of the second edges 4, so that the edge 4 is positioned deeply within the second gripper 22. The auxiliary conveyor 60 is without any function as with FIG. 1.

FIGS. 3 and 4 show the conveying and transfer of objects 2, 2' in pairs. The object is the transfer of the product pairs 2, 2' of each second first gripper 12 to two consecutive second grippers 22, wherein the respective other product pairs 2, 2' are conveyed further by the first grippers 12. They may, for example, be transferred in a further suitably designed transfer region T to a further conveyor. The actuation device 40 is set up accordingly, such that only every second first gripper 12 is opened at opening location S1.

Here, in each case two objects 2, 2' are held by a first gripper 12 in a manner such that their first edges 3, 3' are distanced from one another. The distance d1 between the first conveyor 10 and the stabilisation device 30 is set such that only the object 3' shifted downwards, bears with its second edge 4' on the rest surface 34 and on the abutment element 32 and is thus bent. A gap 5 between the two objects 2, 2' arises by way of this. Moreover, the distance of the abutment elements 31 in the case of FIG. 3 is selected such that only one object 2' of each second object pair 2, 2' contacts an abutment element 32.

With FIG. 3, the extended gripper limb 23 moves into the gap 5 and thus separates the two objects 2, 2'. The position of the gap 5 is well defined by way of the relative positions of the first gripper 12 and the abutment element 32. The leading product 2 is therefore led into the open gripper jaw of that second gripper 22, to which the gripper limb 23 is assigned. The trailing product 2' is led into the intermediate space between the mentioned gripper 22 and the trailing gripper 22 or into the open gripper jaw of the trailing gripper 22. The auxiliary grippers 62 serve for transferring the objects 2, 2' reliably into the respective gripper jaw. For this reason, with the transfer, two second grippers hereinafter indicated as the leading or trailing gripper, are assigned to a product pair.

The auxiliary grippers 62 have two gripper parts 63, 64 which may assume a clamping and an open position relative to one another. The leading gripper part 63 has two support surfaces 63*a*, 63*b* which are at angles to one another. These form an abutment for the second edge 4' of the trailing product 2' of a product pair. This edge 4' runs against the abutment and is firmly clamped by way of closure of the auxiliary gripper 62. The surface of the extended gripper jaw 23 of the leading gripper 22 which is orientated opposite to the conveying direction, thereby acts as an additional support surface. The auxiliary gripper 62 is now moved relative to the second grippers 22 within the transfer region T, such that its abutment edge is aligned to the gripper jaw (base or abutment edge there) of the trailing gripper 22. For this, the paths U2, U6 of the second grippers 22 and of the auxiliary grippers 62 cross, and/or the auxiliary grippers have a variable distance relative to their conveyor member. The gripper 22 is closed at the end of the transfer region T and the auxiliary gripper 62 is opened again. In this manner, the trailing product 2' may be transferred into the trailing gripper 22 in a very controlled manner.

The leading product 2 of a product pair is introduced directly into the open gripper jaw of the leading gripper 22. Also both products 2, 2' of a pair which is not to be transferred, are located in the open gripper jaw. The lower edges 4, 4' of these products however are distanced from the clamping region of the second gripper 22. Moreover, these products 2, 2' are pulled out of the gripper jaw again by way of increasing the distance of the conveying paths U1, U2 towards the end of the transfer region and/or by way of pivoting the first grippers 12 relative to their conveying path U1, and may be moved further by the first grippers 12 which remain closed for this.

With FIG. 4, the objects 2, 2' are lengthened or the distance d1 is shortened compared to the case of FIG. 3, so that both second edges 4, 4' of the offsetly held objects 2, 2' lie on the rest surface 34. In each case, the trailing edge 4' is present on the abutment element 32, whilst the leading edge 4 is located between two abutment elements 32. The rest surface 34 here is separated from the conveyor belt 31, on which the abutment elements 32 are fastened, and is stationary. The rest surface 34 has a displaceable continuation 34' which continues the rest surface 34 and is movable in the direction of the rest surface 34. With this, one may set the point at which the second edges 4, 4' are released, in a precise manner. It is possible, for example, to displace this release point which is defined by the front edge of the rest surface 34 or its displaceable continuation 34', from product to product. Here, the trailing products 2' which are supported by the cam-like abutment element 32 are released directly by the cam 32 (retracted continuation 34') and the release point for the other products 2 is displaced to the front in the conveying direction by way of displacing the continuation 34'. The products 2 are guided in a longer and more controlled manner by way of this.

As with FIG. 3, the products 2, 2' of each second pair are separated by way of the extended gripper jaw 23 moving in, and are conveyed into adjacent second grippers 22. The task of the auxiliary grippers 62 is described with reference to FIG. 3. The remaining pairs are conveyed further also after the transfer region T, by way of the first grippers 12.

FIG. 5 shows a further example for the application of the transfer device 1. A further auxiliary conveyor 70 is applied for dividing the stream of product pairs into two product streams, with which the products 2, 2' in each case are held individually by one gripper 12, 22. This auxiliary conveyor is arranged in the region of the first conveyor 10 such that its auxiliary gripper 72 may support the first grippers 12 with regard to their function, in the transfer region T. The remaining construction is as is described with reference to FIG. 4. In particular, the distance d1 is selected such that both further edges 4, 4' of the objects 2, 2' held in an offset manner lie on the rest surface 34.

The procedure is as follows: the pairs of objects 2, 2' are conveyed by the first grippers 12 into the transfer region T. In front of the transfer region T, the upper auxiliary grippers 72 approach the first grippers 12 from above and move synchronously to these in the transfer region T. The corresponding gripper jaws are aligned to one another in a view onto the plane of the drawing. The auxiliary grippers 72 stop with the closure of only one of the products 2, 2'. Here, that leading product 2 is held, which with its first edge 3 projects beyond the other product 2'. The reverse case (trailing product is located deeper in the gripper 12) is also possible. When opening the first grippers 12, therefore only the trailing product 2' or generally, the product which is introduced less deeply into the gripper 12, is released. The first grippers 12 are closed again at the end of the transfer region T and the auxiliary grippers 72 are opened, so that the leading products 2 are transported further by the first grippers 12. An actuation device which is not shown in more detail here is present for opening and closing the upper auxiliary grippers 72.

The transfer of the trailing products 2' to the second grippers 22 is supported by the lower auxiliary grippers 62. The second grippers 22 and the auxiliary grippers 62, in front of the transfer region T, approach one another from below the plane, in which the second edges 4, 4' are located and pass through this plane at the entry of the transfer region T. The second edge 4' is guided by the support surface 63*a* which here is essentially vertically orientated, and then abuts on the other support surface 63*b*. By way of closing the auxiliary gripper 62, the edge 4' is fixed and in the further course of the transfer region T is transferred into the gripper jaw of the second gripper 22 by way of the relative movement of the second gripper 22 and of the auxiliary grippers 62. The second gripper 22 is closed and the auxiliary gripper 62 is opened again. The respective movement paths U2, U6 then separate again. The product 2' is transported further by the second grippers 22. The leading product 2 does not need to be exactly positioned with respect to the second gripper 22, since it is not transferred to these. Here, first and second grippers 12, 22 are synchronised such that the leading product 2 is temporarily supported by the trailing surface of the long gripper limb 23. In contrast to FIGS. 3 and 4, the long gripper limb 23 here does not separate the product pair.

The movement paths U1, U7 run and the movement of the grippers 72, 12 are controlled, such that the following additional function is realised: the leading product 2 is released by the auxiliary gripper 72 to the first gripper 12 such that at the end of the transfer region T, it is held at a smaller distance to its first edge 3 than at the entry into the transfer region T. The position of the product 2 relative to the first gripper 12 corresponds roughly to the position of the trailing product 2', before this has been released, and thus to an "optimal" product position. The position of the product region which is clamped or held by the gripper 12 may therefore be changed by the temporary transfer to the auxiliary grippers 72. One may succeed in the individual further conveyed objects 2 having a well defined position relative to the gripper. For example, a defined distance of the gripped edge 3 to the base 12*a* of the gripper 12 (lowest point of the gripper) or to the outer ends 12*b* of the gripper limb, may be set. This correction with a differentiated conveying has advantages with subsequent processing steps, with which a certain product position relative to the gripper is necessary. Depending on the position of the products in the first gripper 12, the trailing product may also remain in the first gripper 12. It is also possible not for a distance reduction, but a distance increase to be realised by way of the auxiliary grippers. In any case, the interim transfer to the auxiliary grippers has two functions: on the one hand that object which is to be transported further by the first gripper, is held back in the first gripper during the opening of the first gripper. Thus the other object, which is to be transported further by the second gripper, may be released. On the other hand, the position of the object which is to be further transported, within the gripper, may be corrected with the return to the first gripper.

It is obvious that the positional correction by way of auxiliary grippers with a differentiated conveying of two or more products in a common gripper is independent of the stabilisation device described above and may therefore be applied with any gripper-gripper transfer devices. This is shown schematically in FIG. 6: the transfer device according to FIG. 6 and its operating manner correspond to FIG. 5: in each case one of the products 2 2' which is held by the first grippers 12 is transferred to second grippers 22 and the other is conveyed further by the first gripper 12. The first and second grippers 12,22 are synchronised such that in each case the longer limb of the second grippers 22 moves into the region between two product pairs 2 2'. For this, no stabilisation device is necessary due to the relatively large distances of the first grippers 12.

One recognises that the auxiliary gripper revolving path U7 over a part of the transfer region is parallel to the revolving path U1 of the first grippers 12. After the opening location of the first grippers 12, the revolving paths U1, U7 however run slightly apart, wherein the grippers 12 and the auxiliary grippers 72, however, continue to be aligned with one another seen transversely to the conveying direction. By way of the divergence of the revolving paths U1, U7, the product 2 held by the auxiliary gripper 72 is offset relative to the first gripper 12. On closure of the first gripper 12, it is therefore clamped in a different product region than in front of the transfer region, in the present case this product region is closer to its edge 3 than before. This corresponds roughly to the clamping position of the product 2' to be released, in the initial formation.

Figure 6:
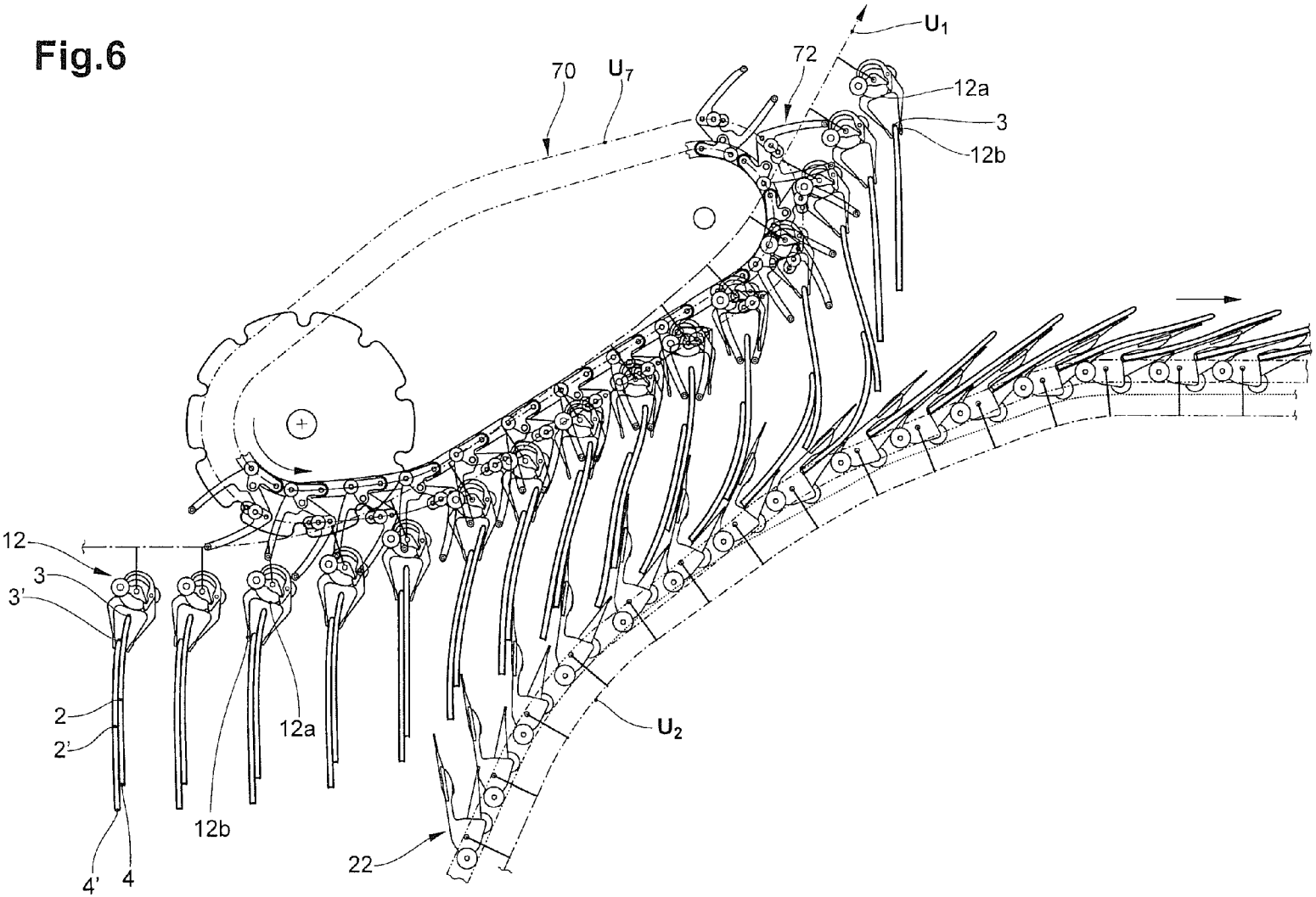
FIG. 6 the transfer device according to FIG. 5 without a stabilisation device.
Figure 7:
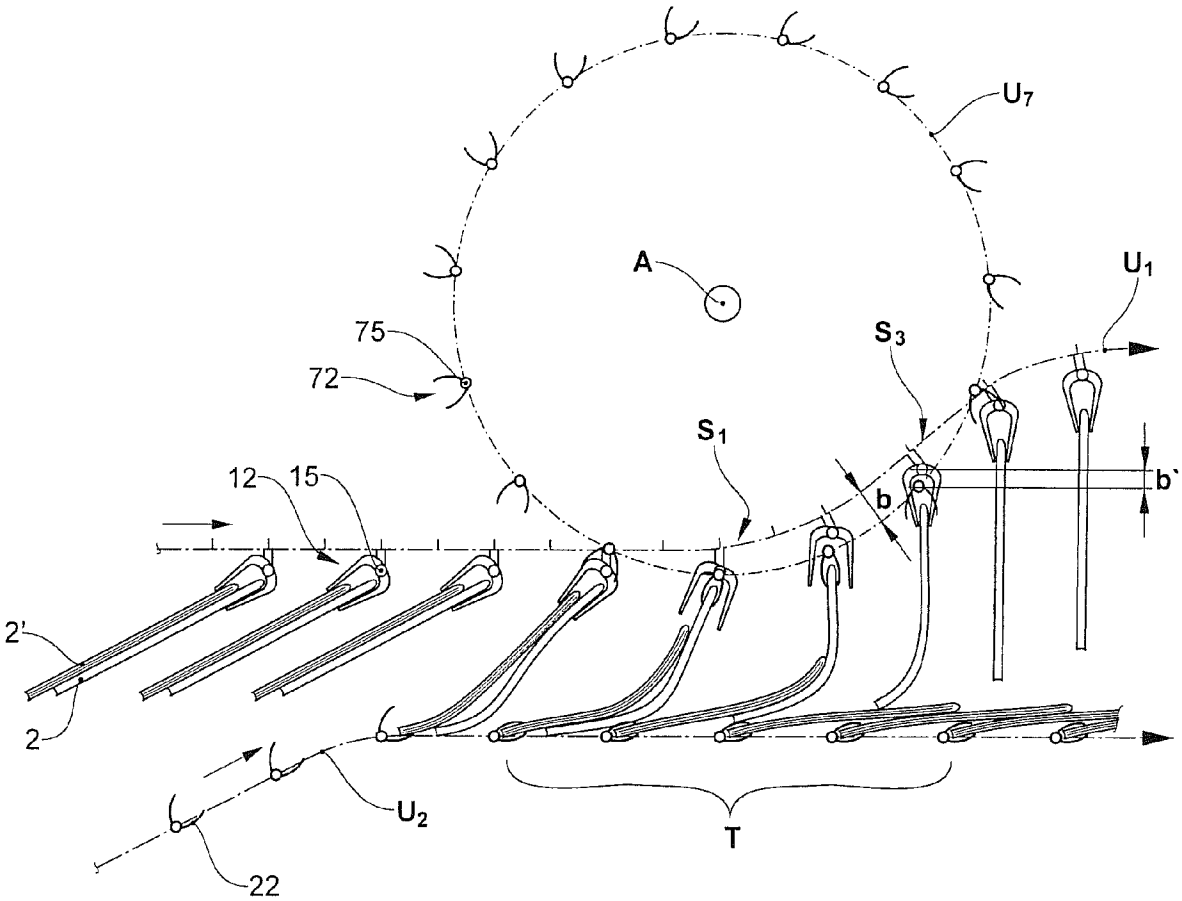
FIG. 7 a variant of the transfer device according to FIG. 6 with a circular revolving path of the auxiliary grippers.

FIG. 7 shows a variant of the device of FIG. 6. The auxiliary gripper conveyor 70 comprises a circular revolving path U7. The circular path is very simple to realise in contrast to the revolving system according to FIG. 6, with which the revolving path U7 is fixed by way of suitably shaped guide means, e.g. a channel. The auxiliary grippers 72 may be fastened on a rigid body and by way of rotation of this about a, here, horizontal axis A, may be moved along a circular path U7. The revolving path U7 intersects the revolving path U1 of the first grippers 12 at two locations. Therebetween lie the locations, at which the first grippers 12 are opened and the auxiliary grippers 72 are closed (here indicated at S1), or the first grippers 12 are closed and the auxiliary grippers 72 are opened (indicated at S3). At these two reference locations S1, S3, the grippers 12 and the auxiliary grippers 72 or their revolving paths U1, U7 have different distances b', b from one another. Here the distance b' if the grippers 12, 72 is defined as the distance of the pivot axes 15, 75 of the gripper jaws. It is zero at S1 and larger than zero at S3. The distance b is the distance of the revolving paths U1, U7. Since the products hang and the gripper jaws point downwards, here in each case only the components in the vertical direction are measured. Thus the product 2 by way of transfer to the auxiliary gripper 72 and renewed receiving by the first gripper 12, is displaced by the distance change Δb or Δb' between the two locations S1, S3. The distance change may be set by way of the selection of the shape and relative position of the revolving paths U1, U7 and of the opening and closure locations S1, S3. It is not necessary for the first grippers and auxiliary grippers to be opened or closed at the same time, and the auxiliary grippers may also be closed before the opening of the main gripper or be opened after the closure of the main gripper.

The auxiliary grippers 72 here may be pivoted relative to their path U7. By way of this, one succeeds in them having an adequately constant orientation in space in the transfer region T.

The auxiliary conveyor 70 may comprise two part auxiliary conveyors which in each case are arranged on different sides of the main conveyor 10 and between which the main conveyor runs, so that the auxiliary conveyor 70 and the main conveyor 10 do not mechanically block. An object which is not to be released is then held in the transfer region by, in each case, two auxiliary grippers to the right and to the left of the main grippers.

Figure 8:
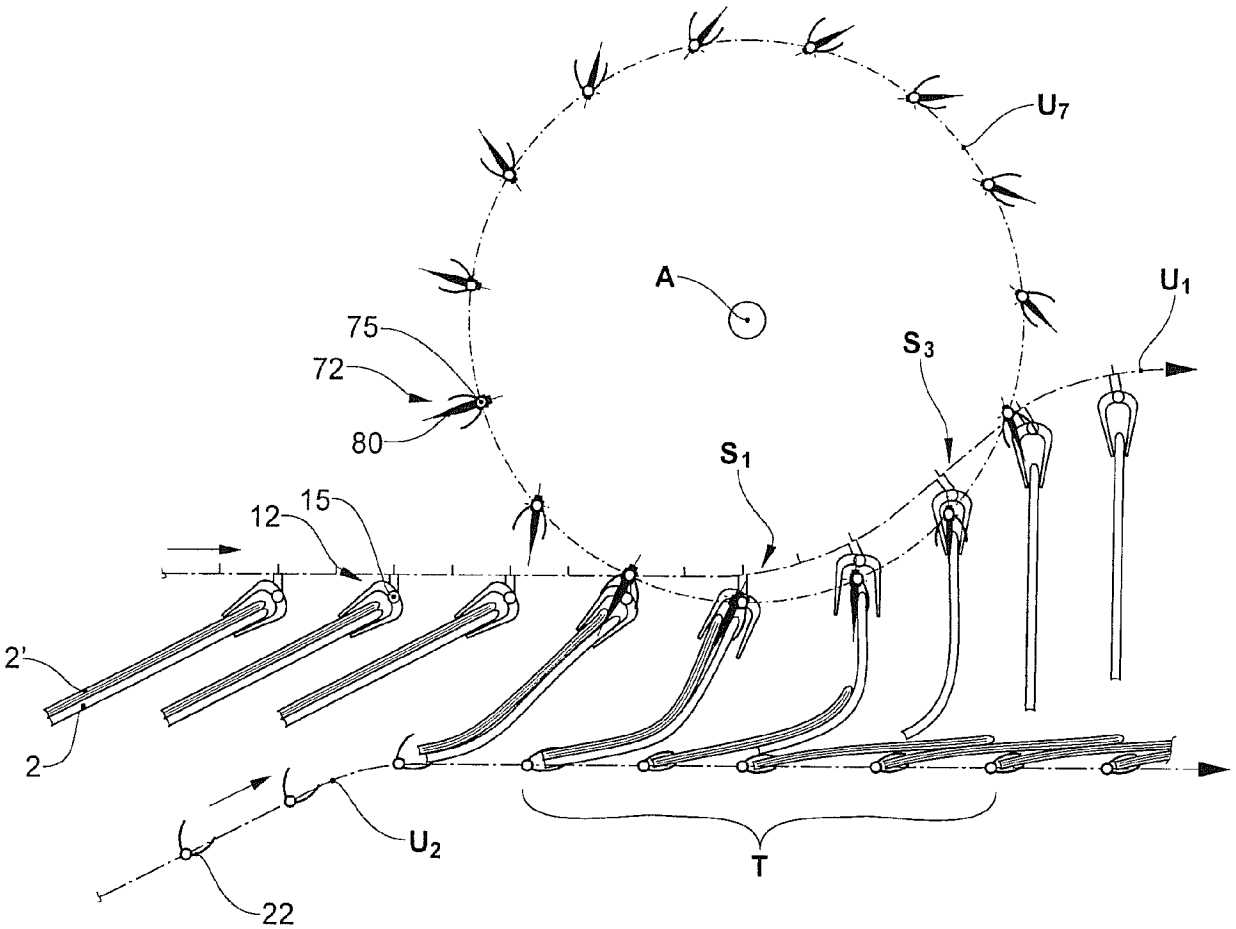
FIG. 8 a variant of the transfer device according to FIG. 7, wherein the auxiliary grippers have additional separating elements.

FIG. 8 shows a variant of the transfer device of FIG. 7, with which the auxiliary grippers 72 additionally comprise separating elements 80 or cooperate with such. The separating elements 80 serve for moving in between two objects 2, 2' of a group of objects which are commonly conveyed in the first gripper 12, laterally of the first gripper 12 (e.g. to the left or right of this) and of excluding selected ones of these objects from the influence of the auxiliary gripper 72, so that these may be gripped by the auxiliary grippers 72 and not the other object or the other objects. The use of such separating elements 80 is above all advantageous if the objects 2, 2' are arranged congruently in the gripper 12, in particular with congruent, gripped edges 3, 3.

Here, in each case two objects 2, 2' with congruent, gripped edges 3, 3' are conveyed by a first gripper 12. At the entry of the transfer region T, the separating element 80 penetrates in the region of the gripped edges 3, 3' between the objects 2, 2'. For this, the separating element 80 projects beyond the outer regions of the gripper limbs of the auxiliary grippers 72. In the further course of the revolving path U7, the auxiliary grippers 72 are closed at S1. Thereby, they grip only one of the objects 2, here the leading one. This is held back in the first gripper 12 by way of this, when this opens. The other object 2' is released to the second gripper 22. Subsequently, the first gripper 12 is closed again at S3 and the auxiliary gripper 72 is opened. As with FIG. 7, the position of the further conveyed object 2 in the first gripper 12 is changed.

The solution described above, with the separating elements 80, may also be applied independently of a positional correction, i.e. the further conveyed objects 2 may be gripped in the same position again which they initially had, by the first gripper 12. The separating elements 80 may be an integral constituent of the auxiliary gripper 72. Their position or orientation relative to the limbs of the auxiliary gripper 72 may preferably be controlled. It is also possible for one of the limbs of the auxiliary grippers 72 to assume the function of a separating element, i.e. to be controlled such that it moves in between the products 2, 2'. The separating elements 80 may however also be fastened in a separate drive system and only be moved synchronously to the auxiliary grippers 72 or to the main grippers 12 in the transfer region. As is the case here, they move between the gripped edges 3, 3'. Alternatively, the separating elements 80 may be introduced from the side (not represented here). The separating elements 80 may be controlled such that they lift the objects lying on one another, from one another, so that the auxiliary gripper 72 may more easily grip the selected objects.

The device variant with the separating elements therefore in its most general form consists of a first gripper conveyor, an auxiliary gripper conveyor as well as several separating elements which are moved along a closed revolving path. This may be identical to the revolving path of the auxiliary grippers, but may also differ therefrom. The separating elements are controlled such that in the transfer region they move in between two objects of a group of objects held commonly by the first grippers, so that selected ones of these objects may be gripped by the auxiliary gripper. The above described positional correction by way of the auxiliary grippers, as well as the stabilisation of the freely downwardly hanging object edges is optional.

The invention claimed is:

1. A device for the transfer of flexible, two-dimensional objects, in particular printed products, between two conveyors, comprising a first gripper conveyor with first grippers that are movable in a conveying direction along a first gripper conveying path, wherein the first grippers are designed for the essentially hanging transport of the objects by way of gripping the objects in a region of a first object edge and at a first distance from the first object edge, a second gripper conveyor with second grippers that are movable along a second gripper conveying path, wherein the second grippers are designed for receiving objects by way of gripping the objects in a region of a second object edge which lies opposite the first object edge, at least one actuation device for opening and closing the first and second grippers such that, in a transfer region, a transfer of the objects from the first grippers to the second grippers may take place, and at least one auxiliary conveyor with auxiliary grippers that are co-movable with the first grippers along an auxiliary conveying path and that, in the transfer region, are capable of gripping the first object edges and holding the objects while the first gripper is open, wherein the gripper conveying path and the auxiliary conveying path run in such a way, and the movements of the first grippers and of the auxiliary grippers are controlled such that, the object held by the auxiliary gripper and transferred back to the first gripper at the end of the transfer region, is held at a second distance to the first object edge, said second distance being different than the first distance.

2. The device according to claim 1, further comprising an opening location at which the first grippers are opened and a closure location at which the first grippers are closed, wherein the auxiliary grippers are closed in front of or at the opening location, and are opened again at or after the closure location.

3. The device according to claim 2, wherein the distances between the first gripper conveying path and the auxiliary conveyor conveying path are different from one another at the opening location and the closure location.

4. The device according to claim 1, wherein the auxiliary conveyor has a circular auxiliary conveyor conveying path, in particular by way of the auxiliary grippers being arranged on a rigid rotatable body.

5. The device according to claim 1, wherein the auxiliary conveyor comprises two auxiliary part-conveyors that in each case are arranged on different sides of the first gripper conveyor, wherein an object that is not to be released is held in the transfer region by in each case two auxiliary grippers.

6. The device according to claim 1, further comprising a stabilisation device for stabilising the objects that are held by the first grippers, wherein the stabilisation device, as seen in the conveying direction, is arranged in front of the transfer region and comprises abutment elements that are co-moved with the first grippers and by way of which the second object edges at an entry of the transfer region are brought into a position that is defined in the conveying direction and in the vertical direction.

7. The device according to claim 6, wherein the stabilisation device is designed such that the second object edge is released at the entry of the transfer region.

8. The device according to claim 6, wherein the stabilisation device is designed and is distanced from the first gripper conveying path, such that at least individual ones of the objects that are gripped by the first grippers are bent by the stabilisation device such that the second object edge trails the first object edge in the conveying direction.

9. The device according to claim 6, wherein the stabilisation device comprises an essentially horizontally orientated rest surface, wherein the abutment elements project from the rest surface and are co-movable with the first grippers.

10. The device according to claim 6, wherein the distance of the stabilisation device to the first gripper conveying path is variable for adaptation to the object length.

11. The device according to claim 1, wherein the distance of the second gripper conveying path to the first gripper conveying path is variable for adaptation to the object length.

12. The device according to claim 1, wherein the first and second gripper conveying paths are converging in front of the transfer region and are orientated essentially parallel to one another in the transfer region.

13. The device according to claim 1, further comprising at least one second auxiliary conveyor with auxiliary grippers that are co-movable with the second grippers along a second auxiliary conveying path and that in the transfer region are capable of gripping the second object edges and holding them.

14. The device according to claim 1, further comprising at least one separating element that, in the transfer region, is capable of moving in between two objects of a group of objects that are commonly held by the first gripper, such that selected ones of these objects may be gripped by the auxiliary grippers the are co-moved with the first grippers.

* * * * *